US008956182B2

(12) United States Patent
Tran et al.

(10) Patent No.: US 8,956,182 B2
(45) Date of Patent: Feb. 17, 2015

(54) CABLE RETENTION APPARATUS HAVING A JACK HOUSING WITH A PLURALITY OF CABLE RETENTION HOOKS

(71) Applicant: Motorola Solutions, Inc., Schaumburg, IL (US)

(72) Inventors: Chi T. Tran, Weston, FL (US); Jean-Robert Achille, Bloomingdale, IL (US); Michael J. Koch, Roselle, IL (US)

(73) Assignee: Motorola Solutions, Inc., Schaumburg, IL (US)

( * ) Notice: Subject to any disclaimer, the term of this patent is extended or adjusted under 35 U.S.C. 154(b) by 36 days.

(21) Appl. No.: 13/748,706

(22) Filed: Jan. 24, 2013

(65) Prior Publication Data

US 2014/0206224 A1 Jul. 24, 2014

(51) Int. Cl.

| | |
|---|---|
| ***H01R 13/72*** | (2006.01) |
| ***H01R 13/58*** | (2006.01) |
| ***H01R 13/639*** | (2006.01) |
| *H01R 24/58* | (2011.01) |

(52) U.S. Cl.

CPC ..... *H01R 13/5833* (2013.01); *H01R 13/6392* (2013.01); *H01R 24/58* (2013.01)

USPC ..... 439/501

(58) Field of Classification Search

USPC ..... 439/445, 501, 701

See application file for complete search history.

(56) References Cited

U.S. PATENT DOCUMENTS

| | | | | |
|---|---|---|---|---|
| 6,146,210 | A | 11/2000 | Cha | |
| 6,908,325 | B2 | 6/2005 | Bernat et al. | |
| 7,106,301 | B2 * | 9/2006 | Smith et al. | 345/163 |
| 7,399,199 | B2 * | 7/2008 | Symons | 439/501 |
| 7,670,060 | B2 | 3/2010 | Ziemke et al. | |
| 7,674,138 | B2 * | 3/2010 | Mori | 439/701 |
| 8,654,987 | B2 * | 2/2014 | Palma | 381/74 |
| 2012/0006581 | A1 * | 1/2012 | Cross | 174/135 |
| 2012/0128193 | A1 | 5/2012 | Stevinson | |

OTHER PUBLICATIONS

"Mac Notebooks: Reducing cable strain on your MagSafe power adapter"—Extracted from—http://support.apple.com/kb/HT1630—Copyright 2013—10 pages.

* cited by examiner

*Primary Examiner* — Chandrika Prasad
(74) *Attorney, Agent, or Firm* — Barbara R. Doutre

(57) ABSTRACT

A jack housing (110) for a plug and jack connector system (120, 110) comprises a plurality of integrated cable retention hooks (114) about which to wrap a cable (124) of a cabled accessory (120). The integrated retention hooks (114) retain the cable (124) so as to avoid inadvertent disconnect of the plug (122) from the jack (116). The integrated retention hooks (114) can accommodate a variety of different diameter cables or multiple cables.

22 Claims, 4 Drawing Sheets

CABLE RETENTION APPARATUS HAVING A JACK HOUSING WITH A PLURALITY OF CABLE RETENTION HOOKS

FIELD OF THE INVENTION

The present invention relates generally to a cable retention apparatus and more particularly to a cable retention apparatus for plug and jack connector system utilized in with a portable communication device.

BACKGROUND

Communication devices, such as portable radios, are often utilized in conjunction with accessory devices, such as audio accessory devices. The interface between radio and accessory devices or between accessory to accessory devices oftentimes includes a cable having a plug which connects to a jack of the radio or accessory, referred to as a plug and jack interface. However, in some interface systems the cable associated with the plug may inadvertently become disconnected from the jack in response to an axial force component being applied to the cable. Cable based plug and jack systems may become disconnected as a result the cable getting caught on objects in the user's environment. For applications in which a cable based plug and jack system is being used for audio transmit and receive, the resulting loss of audio communication incurred upon disengagement of the plug from the jack can be problematic.

Accordingly, there is a need for an improved plug and jack system for use with communication devices.

BRIEF DESCRIPTION OF THE FIGURES

The accompanying figures where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
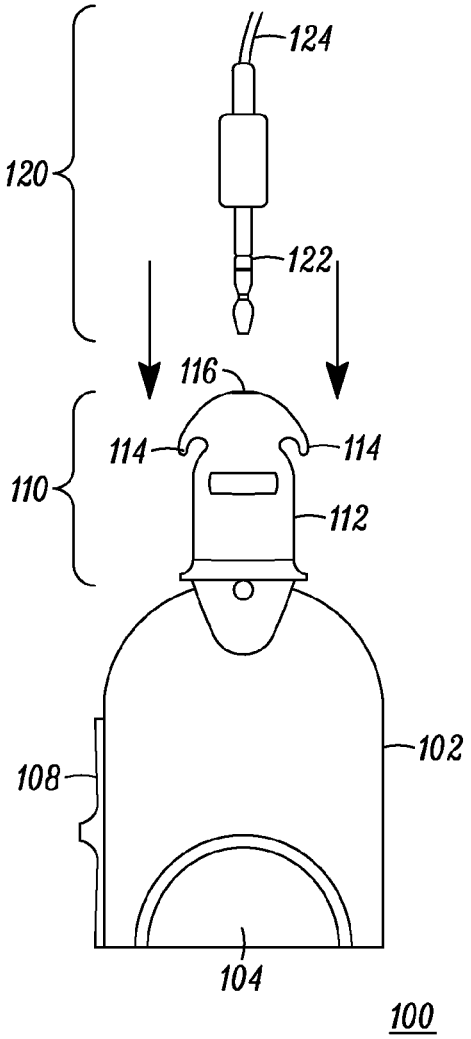
FIGS. 1 and 2 show a cable retention apparatus for a communication system in accordance with the various embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in an improved cord retention apparatus for jack and plug interconnect systems.

Accordingly, the components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

Briefly, there is provided herein a cable retention apparatus for plug and jack connectors. For the purposes of this application the term plug is defined as a female audio connector, and the term jack is defined as the mating male connector. The male mating connector provides a socket within which to insert the plug. The apparatus comprises a jack housing having a plurality of cable retention hooks. The cable retention hooks prevent inadvertent disengagement of a cabled accessory from another device as well as overall cable management.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Figure 2:
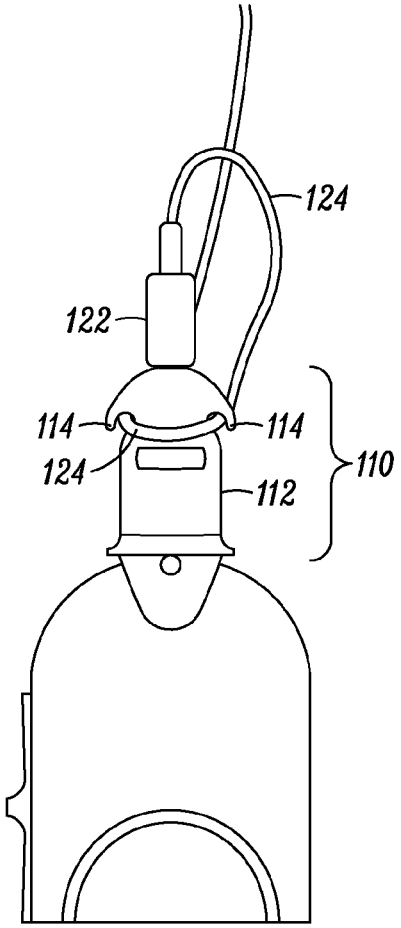

FIGS. 1 and 2 show a cable retention apparatus for communication system 100 in accordance with the various embodiments. Communication system 100 comprises a communication device housing 102 having a jack housing portion 110 having a jack 116 for receiving a plug 122 of a cabled accessory 120. In accordance with the various embodiments, the jack housing portion 110 further comprises a plurality of cable retention hooks 114 formed about the opening of the jack 116 for wrapping and retaining the cable 124, as seen in FIG. 2. The plurality of integrated cable retention hooks 114 provide a predetermined retention force that prevents the mating plug 122 from being pulled out from the jack 116. In accordance with the various embodiments, and as seen in FIGS. 1 and 2, the cable retention hooks 114 are perpendicular to the cable insertion direction, thereby providing pullout resistance. A half turn of the cable 124 to situate the cable within hooks 114 is sufficient to prevent the cable from being pulled out.

The communication device housing 102 may comprise a radio or other accessory device and the cabled accessory 120 comprises an audio accessory device. The cabled accessory 120 may be any type of cabled audio device that couples to a communication device or another accessory. For example, the communication device housing 102 may comprise a first accessory providing a remote push-to-talk (PTT) 104 device with volume control 108, and the second accessory may comprise cabled ear buds, cabled headset, cabled microphone, cabled speaker or the like.

The jack housing portion 110 may be removable from the communication device housing 102 or may be integrated as part of the communication device housing 102. When formed as a unitary part, the jack housing portion 110 and the communication device housing 102 are molded as a single piece part.

Figure 3A:
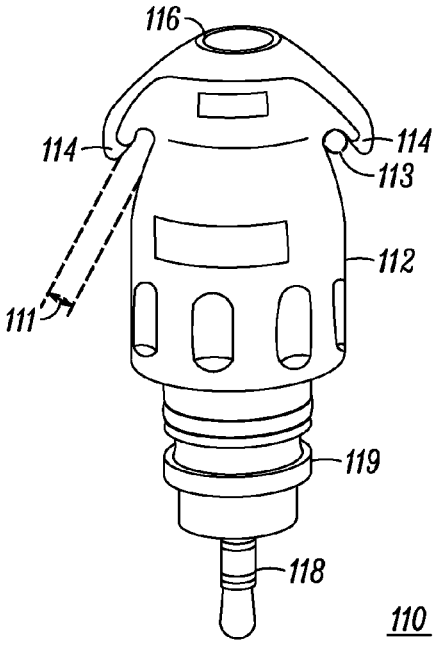
FIG. 3A is a jack housing having the cable retention apparatus formed in accordance with the various embodiments.

FIG. 3A shows the jack housing portion 110 as an individual piece part formed in accordance with the various embodiments. The jack housing 110 is formed of a cylindrical body 112 having the audio jack 116 seated therein. This embodiment shows the jack housing portion 110 as a removable piece part having a first end comprising the jack 116 for receiving a mating plug of a cabled device, and a second end having a male plug for coupling to another device. The male end 118 may be insertably turned and locked into another device via threaded portion 119. The plurality of integrated hooks 114 are not separate adaptive piece parts but are rather integrated within the jack housing portion 110. As such, the jack housing portion 110 with integrated hooks 114 are well suited to jack and plug systems such as a 3.5 mm jack for receiving a 2.5 mm plug. The jack housing portion 110 may be formed of rubber or other suitable material to provide a rugged yet flexible component capable of protecting the jack 116 while still being lightweight enough for body worn devices. The flexibility of the rubber material allows the cable retention hooks 114 to accommodate additional cable diameters including, but not limited to, a double cable architecture. The ruggedness of the rubber material allows for a simple half turn of the cord 124 to provide sufficient retention for protection against axial pull. Thus, the jack 110 is advantageously suited for protecting off-the-shelf connectors (COTS).

Figure 3B:
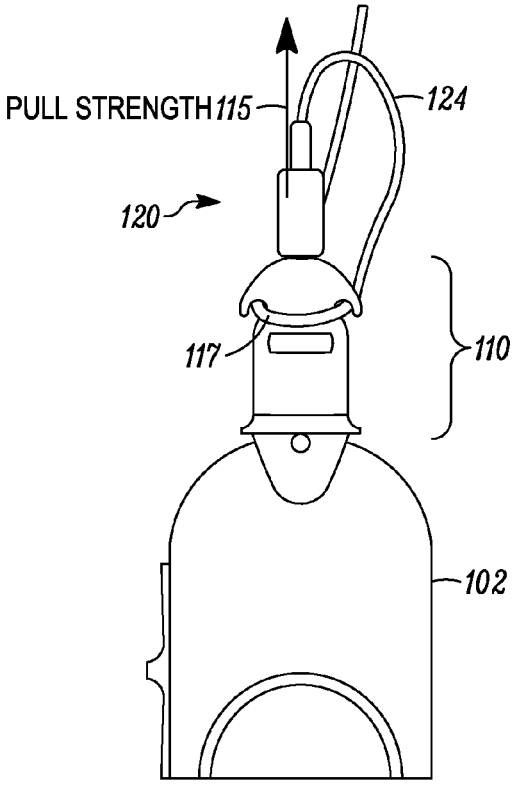
FIG. 3B is the communication device housing with jack housing portion and cabled accessory inserted therein in accordance with various embodiments.

In this embodiment, the jack housing portion 110 shows the opening of the jack 116 and the plurality of integrated cable retention hooks 114 disposed about the jack 116. The integrated cable retention hooks 114 are formed to have a predetermined distance 111 between the hook and the main adapter body and also a predetermined diameter 113 of the hook opening to enable the attachment and retention of a plurality of cable diameters. FIG. 3B shows the communication device housing 102 with jack housing portion 110 having the cabled accessory 120 inserted therein in accordance with various embodiments. Good pull strength results (pull out resistance), on the order of 12.3 lb have been obtained with a half turn 117 of cable 124 within two hooks, each hook having a diameter 113 of substantially 1.7 mm and an open distance 111 of substantially 0.74 mm. Additionally, the selection of the number of hooks as well as the inner diameter and opening width further optimizes the amount of cable loading capability sustainable by the plurality of integrated cable retention hooks 114. Unlike single hook devices, the use of at least two cable retention hooks provides for an even load distribution.

When utilized as an individual piece part, the jack housing portion 110 may be implemented into legacy products that have a jack and plug audio interface without having to redesign the cabled accessory 120 nor the communication device housing 102.

Figure 4:
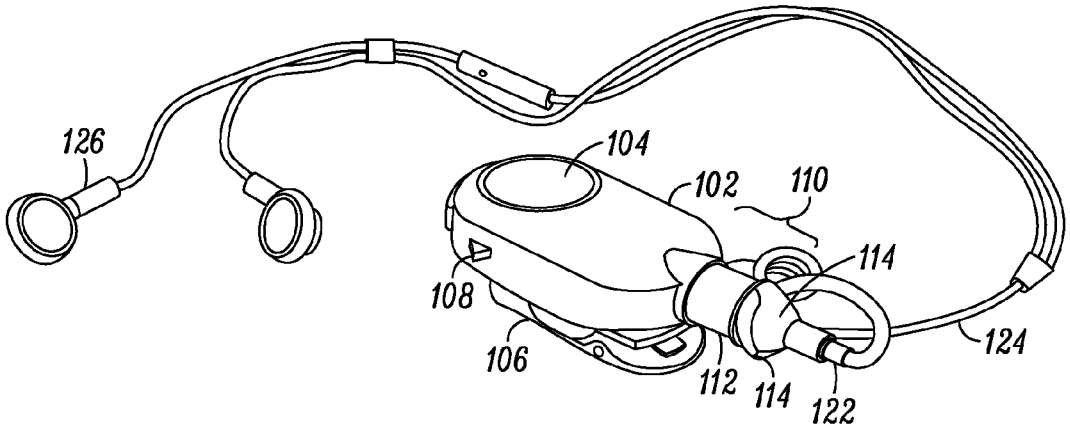
FIG. 4 is a communication system having the cord retention apparatus in accordance with the various embodiments.

FIG. 4 is a communication system having the jack and plug interface 110, 120 in accordance with the various embodiments. As seen in this view, the jack housing portion 110 is coupled to communication device housing 102 which provides PTT 104, clip 106 and volume control 108. The cabled accessory 120 provides ear buds 126 through cable 124 which is plugged into the jack 116 of jack housing portion 110. The ruggedness and portability provided by the audio jack housing 110 makes particularly desirable for use with communication devices utilized in the public safety environment, such as law enforcement, security, and emergency rescue.

Figure 5:
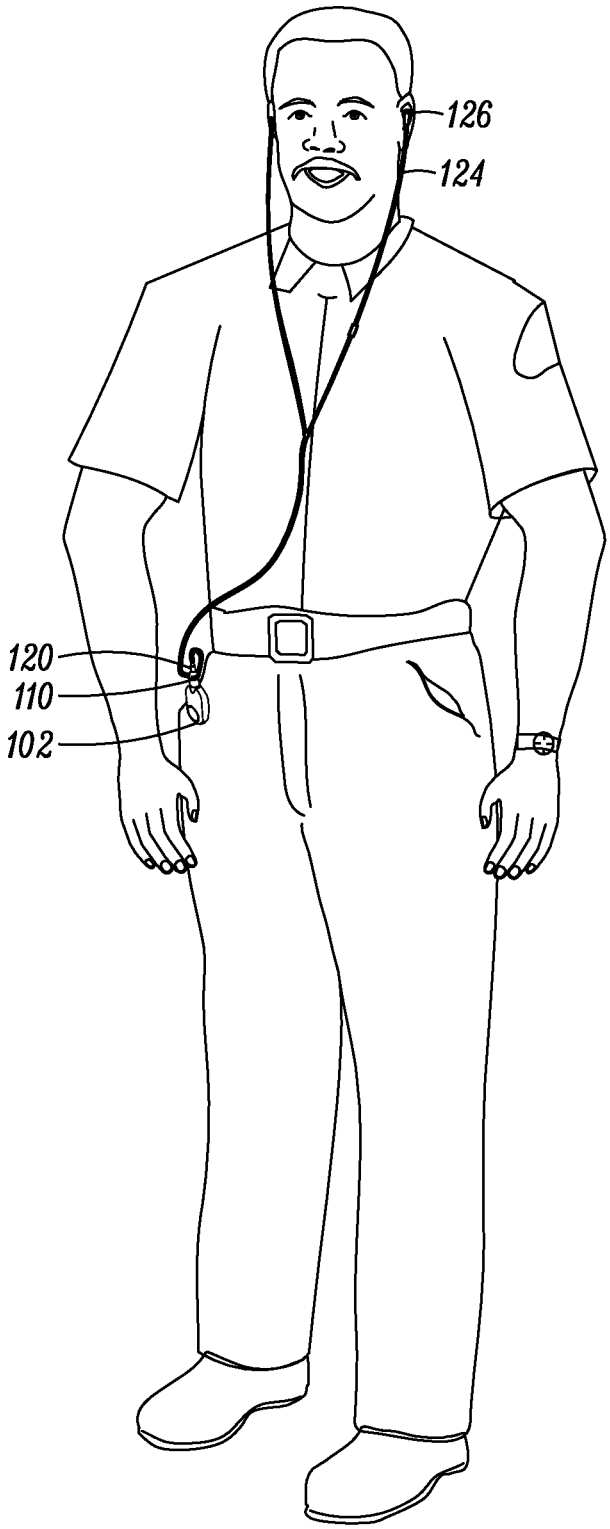
FIG. 5 is the communication system of FIG. 4 formed in accordance with the various embodiments being worn by a user.

FIG. 5 is the communication system of FIG. 4 formed in accordance with the various embodiments being worn by a user. The user can easily manage the various user interface functions such as PTT 104, clip 106 and volume control 108 and ear buds 126. In accordance with the various embodiments, the user is able to wrap cable 124 about the cable retention hooks 114 so as to prevent inadvertent disconnect of the cabled accessory 120 from the communication device housing 102. Thus, the cable retention apparatus provided by the various embodiments is highly beneficial for body worn communication devices.

Accordingly, there has been provided an improved cable retention apparatus. The user controllable apparatus avoids inadvertent disconnection of a plug from a jack. The jack housing 110 having integrated cable retention hooks 114 is beneficial to users of cabled accessory products, particularly the management of different devices worn about the body. Portable handheld radio products, especially body worn type devices, which may utilize several accessories can benefit from the cable management and improved robustness and safety through the minimization of loose or dangling cords. The jack housing 110 may be implemented into legacy products that utilize a jack and plug audio interface without having to redesign the communication device housing 102 or cable accessory 120.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A cable retention apparatus, comprising:

a communication device housing having a jack housing portion for receiving a plug of a cabled accessory; and the jack housing portion of the communication device housing comprising, a first end having an audio jack for receiving the plug of the cabled accessory, a second end having a male plug and threaded portion for coupling and locking the jack housing portion to the communication device housing, and a plurality of cable retention hooks formed on the jack housing portion for wrapping and retaining a cable of the cabled accessory.

2. The cable retention apparatus of claim 1, wherein the plurality of cable retention hooks are molded as part of the jack housing portion.

3. The cable retention apparatus of claim 1, wherein the plurality of cable retention hooks are spaced from the jack housing portion by a predetermined inner diameter and predetermined opening width for accommodating a plurality of cable diameters.

4. The cable retention apparatus of claim 1, wherein a half turn of the cable within the plurality of cable retention hooks prevents removal of the cable.

5. The cable retention apparatus of claim 1, wherein the cabled accessory is an audio accessory.

6. The cable retention apparatus of claim 1, wherein jack housing portion couples a first accessory to a second accessory.

7. The cable retention apparatus of claim 1, wherein the communication device housing comprises a remote push-to-talk device and the cabled accessory comprises cabled ear buds.

8. The cable retention apparatus of claim 1, wherein the plurality of cable retention hooks of the jack housing portion are dimensioned to increase a force required to pull the plug from the audio jack.

9. The cable retention apparatus of claim 1, wherein the communication device housing comprises a radio and the cabled accessory comprises an audio accessory device.

10. The cable retention apparatus of claim 1, wherein the communication device housing comprises a housing for a first accessory device and the cabled accessory comprises a second accessory device.

11. The cable retention apparatus of claim 1, wherein the communication device housing and cabled accessory are body worn devices.

12. The cable retention apparatus of claim 1, wherein the jack housing portion is removable from the communication device housing.

13. The cable retention apparatus of claim 1, wherein the jack housing portion and the communication device housing are molded as a single piece part.

14. The cable retention apparatus of claim 1, wherein the plurality of cable retention hooks are perpendicular to cable insertion direction, thereby providing pullout resistance.

15. The cable retention apparatus of claim 14, wherein the plurality of cable retention hooks are dimensioned to retain and prevent removal of a double cable architecture.

16. The cable retention apparatus of claim 1, wherein the plurality of cable retention hooks provide a predetermined retention force that prevents the mating plug from being pulled out from the jack housing.

17. A cable retention apparatus, comprising:

a jack housing comprising a first end having a jack for receiving a mating plug of a cabled accessory;

the jack housing comprising a second end having a male plug and a threaded portion for coupling and locking the jack housing to another device; and the jack housing comprising a plurality of integrated cable retention hooks.

18. The cable retention apparatus of claim 17, wherein the plurality of integrated cable retention hooks have a predetermined inner diameter and a predetermined opening width for attachment and retention of a plurality of cable diameters.

19. The cable retention apparatus of claim 17, wherein the plurality of integrated cable retention hooks provide a predetermined retention force that prevents the mating plug from being pulled out from the jack housing.

20. The cable retention apparatus of claim 17, wherein the plurality of integrated cable retention hooks are optimized for predetermined loading of a cable.

21. The cable retention apparatus of claim 17, wherein the plurality of integrated cable retention hooks are perpendicular to cable insertion direction, thereby providing pullout resistance.

22. The cable retention apparatus of claim 17, wherein a half turn of a cable within the plurality of integrated cable retention hooks prevents removal of the cable from the jack.

* * * * *